US007042414B1

(12) United States Patent
Lee

(10) Patent No.: US 7,042,414 B1
(45) Date of Patent: May 9, 2006

(54) ULTRA WIDEBAND INTERNAL ANTENNA

(75) Inventor: Jae Chan Lee, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 11/007,200

(22) Filed: Dec. 9, 2004

(30) Foreign Application Priority Data

Oct. 26, 2004 (KR) ..... 10-2004-0085775

(51) Int. Cl.
*H01Q 9/28* (2006.01)

(52) U.S. Cl. ..... 343/795; 343/865

(58) Field of Classification Search ..... 343/795, 343/850, 700 MS, 767, 770, 865
See application file for complete search history.

(56) References Cited

U.S. PATENT DOCUMENTS 5,828,340 A 10/1998 Johnson ..... 343/702
6,512,488 B1 * 1/2003 Schantz ..... 343/795
2002/0175876 A1 * 11/2002 Schantz ..... 343/850

* cited by examiner

*Primary Examiner*—Wilson Lee
*Assistant Examiner*—Jimmy Vu
(74) *Attorney, Agent, or Firm*—Lowe Hauptman & Berner, LLP

(57) ABSTRACT

The present invention relates to an ultra wideband (UWB) internal antenna. The ultra wideband internal antenna includes a first radiation part, a feeding line, a second radiation part, and a ground part. The first radiation part is formed on a top surface of a dielectric substrate and provided with an internal slot. The feeding line supplies a current to the first radiation part. The second radiation part is formed in the internal slot of the first radiation part on the top surface of the dielectric substrate, the second radiation part being conductive. The ground part grounds both the first and second radiation parts. The second radiation part determines an ultra wideband by mutual electromagnetic coupling with the first radiation part using a current element induced due to the current supplied to the first radiation part.

11 Claims, 10 Drawing Sheets

(a)

(b)

(a)

(b)

ULTRA WIDEBAND INTERNAL ANTENNA

RELATED APPLICATION

The present application is based on, and claims priority from, Korean Application Number 2004-0085775, filed Oct. 26, 2004, the disclosure of which is hereby incorporated by reference herein in its entirety.

BACKGROUND OF THE INVENTION

1. Field of the Invention

The present invention relates generally to an antenna provided in a mobile communication terminal to transmit and receive radio signals and, more particularly, to an ultra wideband internal antenna, which is provided in a mobile communication terminal and is capable of processing ultra wideband signals.

2. Description of the Related Art

Currently, mobile communication terminals are required to provide various services as well as be miniaturized and lightweight. To meet such requirements, internal circuits and components used in the mobile communication terminals trend not only toward multi-functionality but also toward miniaturization. Such a trend is also applied to an antenna, which is one of the main components of a mobile communication terminal.

For antennas generally used for mobile communication terminals, there are helical antennas and Planar Inverted F Antennas (hereinafter referred to as "PIFA"). Such a helical antenna is an external antenna fixed on the top of a terminal and has a function of a monopole antenna. The helical antenna having the function of a monopole antenna is implemented in such a way that, if an antenna is extended from the main body of a terminal, the antenna is used as a monopole antenna, while if the antenna is retracted, the antenna is used as a $\lambda/4$ helical antenna.

Such an antenna is advantageous in that it can obtain a high gain, but disadvantageous in that Specific Absorption Rate (SAR) characteristics, which are the measures of an electromagnetic wave's harm to the human body, are worsened due to the omni-directionality thereof. Further, since the helical antenna is designed to protrude outward from a terminal, it is difficult to design the external shape of the helical antenna to provide an attractive and portable terminal. Since the monopole antenna requires a separate space sufficient for the length thereof in a terminal, there is a disadvantage in that product design toward the miniaturization of terminals is hindered.

In the meantime, in order to overcome the disadvantage, a Planar Inverted F Antenna (PIFA) having a low profile structure has been proposed. FIG. 1 is a view showing the construction of a general PIFA.

The PIFA is an antenna that can be mounted in a mobile terminal. As shown in FIG. 1, the PIFA basically includes a planar radiation part 1, a short pin 3 connected to the planar radiation part 1, a coaxial line 5 and a ground plate 7. The radiation part 1 is fed with power through the coaxial line 5, and forms impedance matching by short-circuiting the ground plate 7 using the short pin 3. The PIFA must be designed in consideration of the length L of the radiation part 1 and the height H of the antenna according to the width Wp of the short pin 3 and the width W of the radiation part 1.

Such a PIFA has directivity that not only improves Specific Absorption Rate (SAR) characteristics by attenuating a beam (directed to a human body) in such a way that one of all the beams (generated by current induced to the radiation part 1), which is directed to the ground, is induced again, but also enhances a beam induced in the direction of the radiation part 1. Furthermore, the PIFA acts as a rectangular microstrip antenna, with the length of the rectangular, planar radiation part 1 being reduced by half, thus implementing a low-profile structure. Furthermore, the PIFA is an internal antenna that is mounted in a terminal, so that the appearance of the terminal can be designed beautifully and the terminal has a characteristic of being invulnerable to external impact.

Generally, Ultra WideBand (UWB) denotes an advanced technology of realizing together the transmission of high capacity data and low power consumption using a considerably wide frequency range of 3.1 to 10.6 GHz. In Institute of Electrical and Electronic Engineers (IEEE) 802.15.3a, the standardization of UWB has progressed. In such a wideband technology, the development of low power consumption and low cost semiconductor devices, the standardization of Media Access Control (MAC) specifications, the development of actual application layers, and the establishment of evaluation methods in high frequency wideband wireless communication have become major issues. Of these issues, in order to execute a wideband technology in mobile communication applications, the development of a small-sized antenna that can be mounted in a portable mobile communication terminal is an important subject. Such an ultra wideband antenna is adapted to convert an electrical pulse signal into a radio wave pulse signal and vice versa. In particular, when an ultra wideband antenna is mounted in a mobile communication terminal, it is especially important to transmit and receive a radio wave without the distortion of a pulse signal in all directions. If the radiation characteristic of an antenna varies according to direction, a problem occurs such that speech quality varies according to the direction the terminal faces. Further, since a pulse signal uses an ultra wide frequency band, it is necessary to maintain the above-described isotropic radiation pattern uniform with respect to all frequency bands used for communication.

FIG. 2 is a view showing the construction of a conventional wideband antenna.

The antenna shown in FIG. 2 is a wideband antenna disclosed in U.S. Pat. No. 5,828,340 entitled "Wideband sub-wavelength antenna". A wideband antenna 2 of the U.S. patent includes a tap 10 having a tapered region 20, a ground plane 14 and a feeding transmission line 12 on a substrate 4. The bottom end 18 of the tap 10 has a width equal to that of a center conductor 12*a* of the feeding transmission line 12. The tapered region 20 is located between the top edge 16 and the bottom end 18 of the tap 10. Such a conventional wideband antenna has a frequency bandwidth of about 40%. However, when a radiation pattern in a horizontal plane, that is, a radiation pattern formed in y-z directions, is observed using a frequency function, the conventional wideband antenna exhibits isotropy in a low frequency band, but much radiation occurs in the transverse direction of the tap 10 (that is, a y direction) as the frequency increases. That is, the wideband antenna 2 is advantageous in that in an inexpensive planar wideband antenna can be implemented using Printed Circuit Board (PCB) technology, but problematic in that, as the frequency increases, serious distortion occurs and the antenna 2 has directionality. Further, the antenna is also problematic in that, since the size of the tap 10 emitting radiation is somewhat large, the tap 10 must occupy a large space in a mobile terminal.

SUMMARY OF THE INVENTION

Accordingly, the present invention has been made keeping in mind the above problems occurring in the prior art, and an object of the present invention is to provide an ultra wideband internal antenna, which has an isotropic radiation structure and is capable of processing ultra wideband signals.

Another object of the present invention is to provide an ultra wideband internal antenna, which can be easily miniaturized while being provided in a mobile communication terminal.

In order to accomplish the above object, the present invention provides an ultra wideband internal antenna, comprising a first radiation part formed on a top surface of a dielectric substrate and provided with an internal slot; a feeding line for supplying a current to the first radiation part; a second radiation part formed in the internal slot of the first radiation part on the top surface of the dielectric substrate, the second radiation part being conductive; and a ground part for grounding both the first and second radiation parts, wherein the second radiation part determines an ultra wideband by mutual electromagnetic coupling with the first radiation part using a current element induced due to the current supplied to the first radiation part.

Preferably, the first radiation part may have an outer circumference formed in a substantial rectangle shape.

Preferably, the internal slot of the first radiation part may be formed in a substantial circle shape.

Preferably, the feeding line may be formed in a CO-Planar Waveguide Ground (CPWG) structure.

Preferably, the second radiation part may be formed so that a height (H') thereof is greater than a height (H) of the first radiation part.

Preferably, the second radiation part may be formed in a substantial circle shape.

Preferably, the second radiation part may be formed in the shape of a dielectric column, the dielectric column having a top surface to which a conductive material is applied.

Preferably, the second radiation part may be formed in the shape of a dielectric column, the dielectric column having a top surface and side surfaces to which a conductive material is applied.

Preferably, the second radiation part may be formed in the shape of a dielectric column, the dielectric column having a conductive material formed therein.

Preferably, the second radiation part may be made of a conductor.

Preferably, the ground part may include upper ground parts that are formed on opposite sides of the feeding line on the top surface of the substrate, and lower ground parts that are formed on a bottom surface of the substrate and directly connected to the second radiation part through a conductive line.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
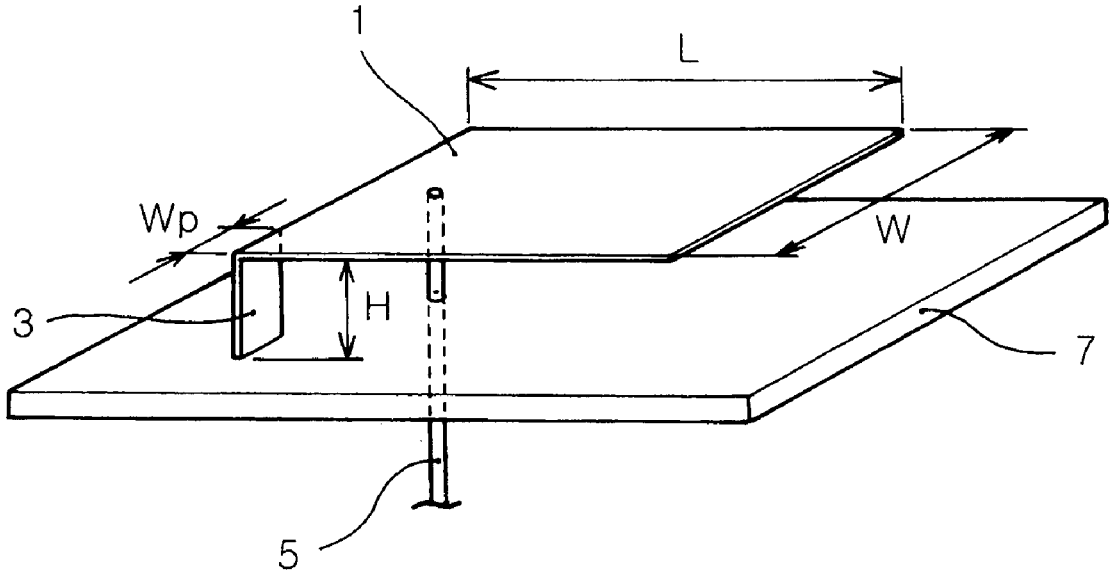
PRIOR ART FIG. 1
FIG. 1 is a view showing the construction of a typical Planar Inverted F Antenna (PIFA)
Figure 2:
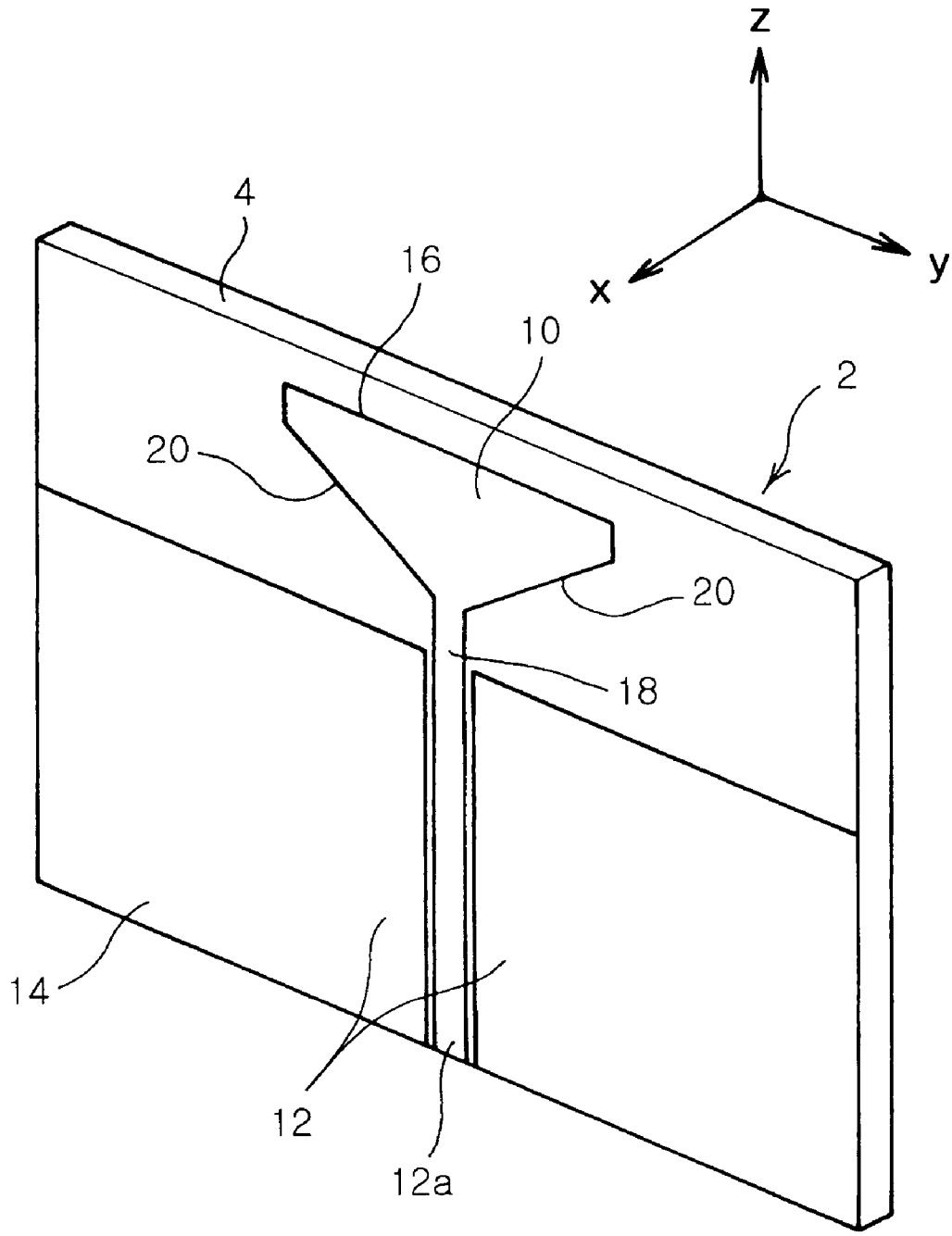
PRIOR ART FIG. 2
FIG. 2 is a view showing the construction of a conventional wideband antenna.

Preferred embodiments of the present invention are described with reference to the attached drawings below. Reference now should be made to the drawings, in which the same reference numerals are used throughout the different drawings to designate the same or similar components. In the following description of the present invention, detailed descriptions may be omitted if it is determined that the detailed descriptions of related well-known functions and construction may make the gist of the present invention unclear.

Figure 3:
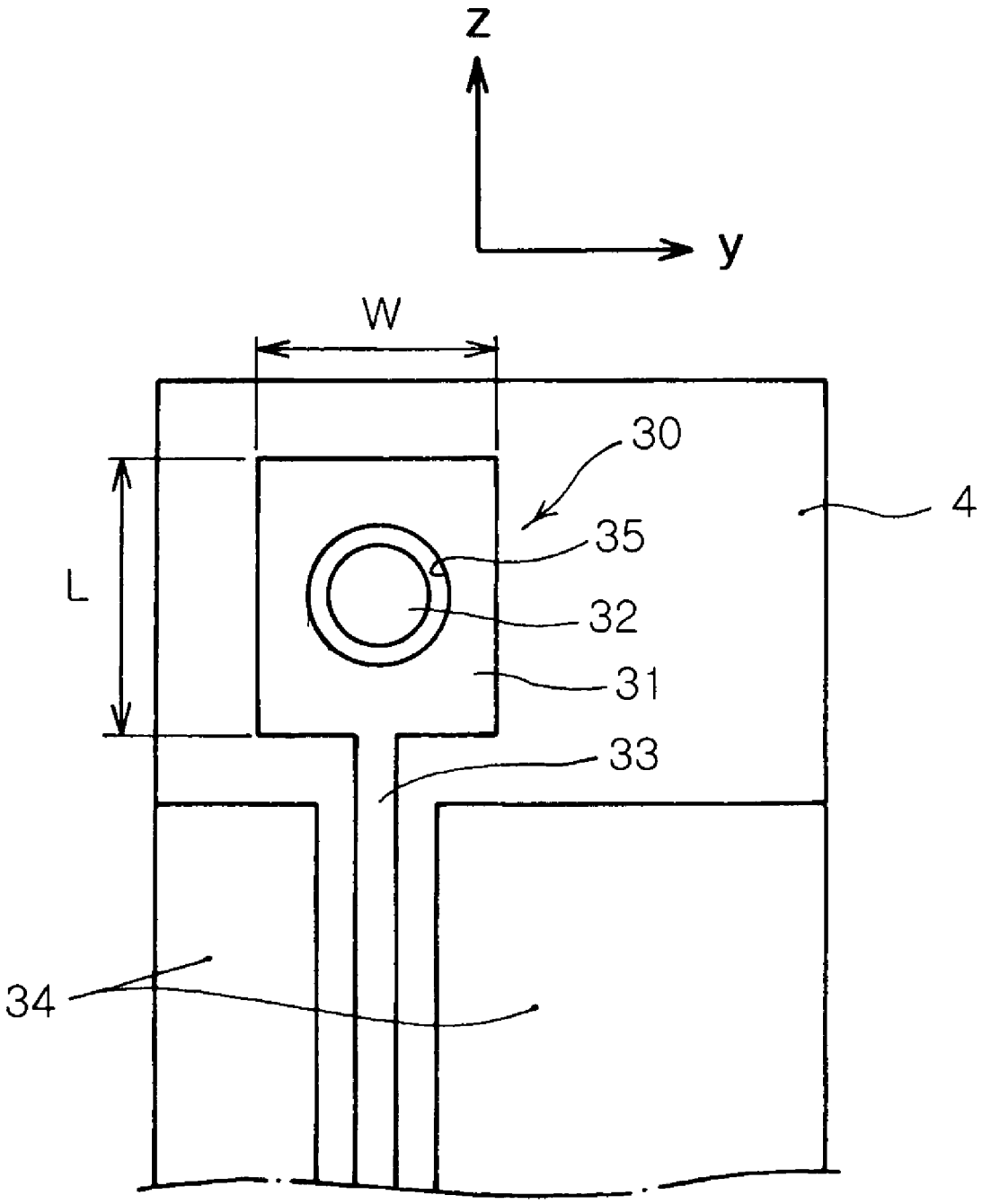
FIG. 3 is a plan view of an ultra wideband internal antenna according to an embodiment of the present invention.

FIG. 3 is a top view of an ultra wideband internal antenna according to an embodiment of the present invention.

Referring to FIG. 3, an ultra wideband internal antenna 30 according to an embodiment of the present invention includes first and second radiation parts 31 and 32, a feeding line 33, upper ground parts 34, and lower ground parts (not shown) that are formed on a dielectric substrate 4.

Preferably, the first radiation part 31 may have an outer circumference formed in a substantial rectangle shape, preferably a rectangle shape having a vertical length (L) slightly greater than a horizontal width (W). For example, the first radiation part 31 can be miniaturized to such an extent that length (L)×width (W) is approximately 1 cm×0.8 cm. Further, the first radiation part 31 has an internal slot 35. The internal slot 35 is formed by eliminating an internal portion of the first radiation part 31, and is preferably formed in a circle shape. The shapes of the first radiation part 31 and the internal slot 35 can vary according to the ground and radiation characteristics of the antenna 30.

The second radiation part 32 is formed in the slot 35 of the first radiation part 31. Preferably, the second radiation part 32 has a size smaller than that of the slot 35 and is formed in a substantial circle shape. The second radiation part 32 may be concentric with the internal slot 35 in the first radiation part 31. In the meantime, the center of the second radiation part 32 may be somewhat spaced apart from the center of the internal slot 35 of the first radiation part 31. The second radiation part 32 may be formed using a dielectric material, such as ceramic, polymer or composite material. Further, the second radiation part 32 is preferably formed in a column shape with a height greater than that of the first radiation part 31 in a direction vertical to the transverse direction (y-z directions) of the first planar radiation part 31.

The shape of the second radiation part 32 can also vary according to the ground and radiation characteristics of the antenna 30.

The feeding line 33 is formed in a long conductor line shape between the upper ground parts 34, and has a CO-Planar Waveguide Ground (CPWG) structure. The feeding line 33 supplies a current to the first radiation part 31.

The upper ground parts 34 are formed on both sides of the feeding line 33, and the upper ends thereof are spaced apart from the lower ends of the first radiation part 31 by a predetermined distance. Further, the antenna 30 of the present invention may include lower ground parts (not shown) formed on the bottom surface of the substrate 4. The second radiation part 32 is connected to the lower ground parts using a conductive line through a via formed in the substrate 4, so that a ground can be formed.

Figure 4:
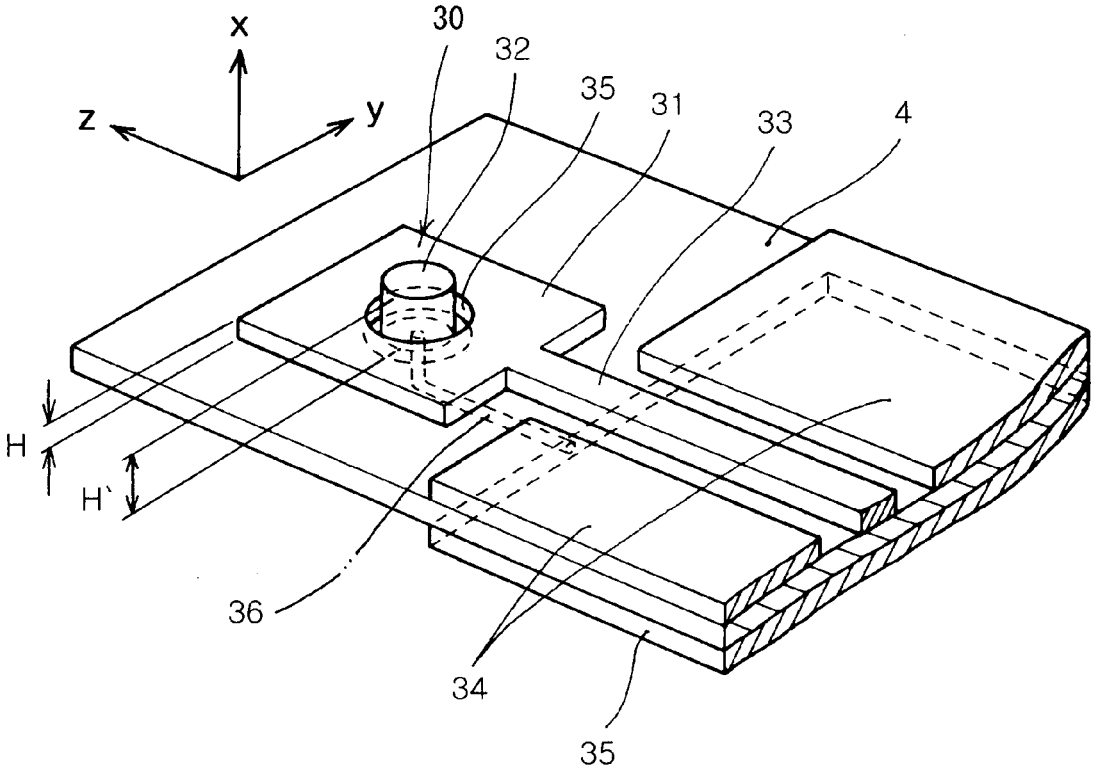
FIGS. 4*a* and 4*b* are a perspective view and a side view, respectively, of an ultra wideband internal antenna according to an embodiment of the present invention.
Figure 4:
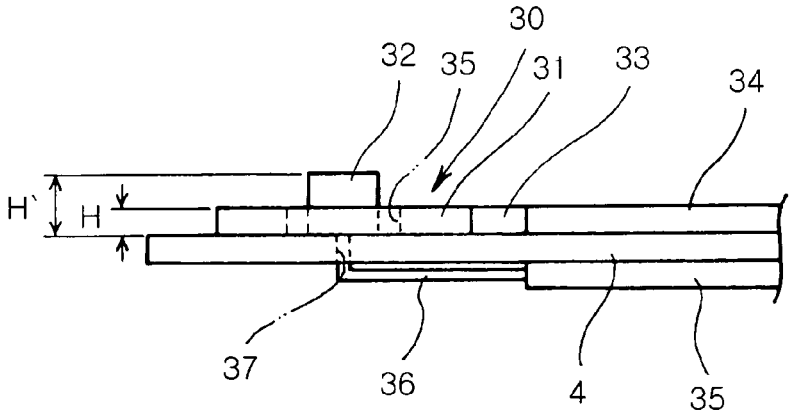

FIGS. 4*a* and 4*b* are a perspective view and a side view, respectively, of an ultra wideband internal antenna according to an embodiment of the present invention.

Referring to FIGS. 4*a* and 4*b*, the second radiation part 32 may be formed in a column shape with a height (H') greater than a height (H) of the first planar radiation part 31 in a direction vertical to the substrate 4. The second radiation part 32 may be made of a dielectric material including a conductive material. In this case, the second radiation part 32, made of the column-shaped dielectric material, may be designed so that a conductive material is applied to the top surface of the second radiation part 32 or to both the top and side surfaces thereof. Further, the second radiation part 32 may be formed in a structure in which a conductor is inserted and layered in a column-shaped dielectric material. In addition, the second radiation part 32 may be formed using only a conductor without including a dielectric material. Further, the vertical height (H') of the second radiation part 32 is adjusted depending on the electromagnetic environment of a mobile communication terminal on which the antenna 30 is mounted, thus tuning the VSWR characteristics and the radiation characteristics of the antenna 30.

In the antenna 30 of the present invention, the first radiation part 31 is formed in a plate shape in a horizontal plane defined by x-y directions, and the second radiation part 32 is formed in a direction (a z direction) vertical to the horizontal plane, so that the antenna 30 has a three-dimensional structure, thus obtaining isotropic radiation characteristics. Further, the second radiation part 32 is connected to a lower ground part 35 formed on the bottom surface of the substrate 4 using a conductive line 36 through a via formed in the substrate 4.

The ultra wideband internal antenna according to the embodiment of the present invention can form an ultra wideband of 3.1 to 10.6 GHz by the following process. If a current is supplied in a z axis direction through the feeding line 33, the current in the z axis direction is distributed in the first radiation part 31. Further, a current element distributed in the z axis direction is generated in the second radiation part 32 due to the electromagnetic coupling with the first radiation part 31, so that the second radiation part 32 separately radiates a radio wave. Therefore, a gap 37 between the first and second radiation parts 31 and 32 is adjusted, so that an ultra wideband of 3.1 to 10.6 GHz can be formed due to the electromagnetic coupling.

Figure 5:
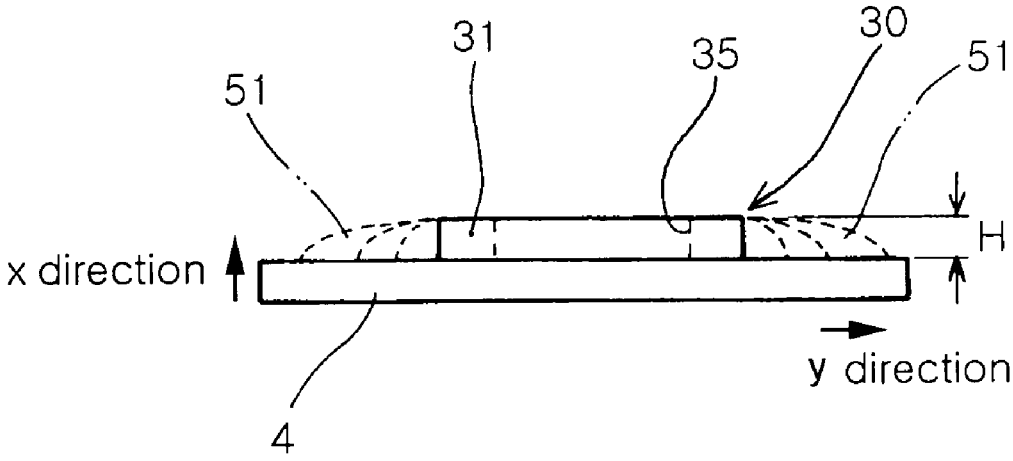
FIGS. 5*a* and 5*b* are views showing the comparison of the radiating elements of an antenna having a first radiation part with the radiating elements of an antenna having first and second radiation parts according to an embodiment of the present invention.
Figure 5:
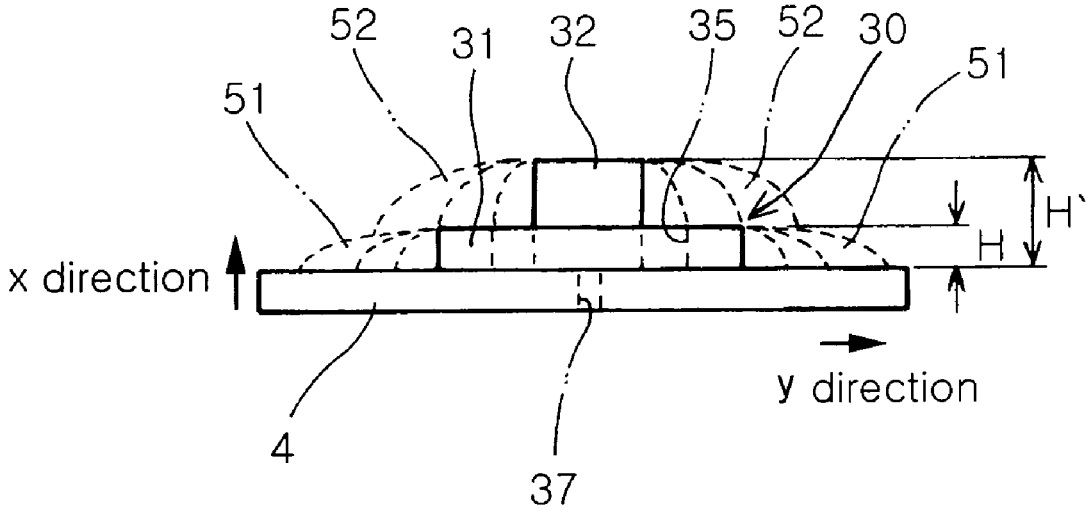

FIGS. 5*a* and 5*b* are views showing the comparison of the radiating elements of an antenna 30 having a first radiation part 31 with the radiating elements of an antenna 30 having first and second radiation parts 31 and 32 according to an embodiment of the present invention.

First, FIG. 5*a* shows a radiating element 51 when a current is supplied to the first radiation part 31 through a feeding line 33 under the condition in which the second radiation part 32 does not exist. Referring to FIG. 5*a*, since the first radiation part 31 is planar, the distance (H) between the antenna and the ground is short in a vertical direction (an x axis direction). Therefore, in the case of the radiating element 51 formed by the first radiation part 31, radiating elements are insufficient in the x axis direction, and mutual interference between the electromagnetic waves of the radiating elements of the x axis or the radiating elements of x and y axes become serious toward higher frequencies of 6 to 10 GHz, having relatively shorter wavelengths, rather than lower frequencies of 2 to 4 GHz. Accordingly, the probability of causing destructive interference at the higher frequencies increases at the time of radiating a radio wave. That is, when only the first radiation part 31 is used, the antenna distorts directivity to a specific direction, and excessive ripples are generated, thus losing isotropic radiation characteristics.

FIG. 5*b* is a view showing the radiation pattern of the antenna 30 having both the first and second radiation parts 31 and 32 according to an embodiment of the present invention. Referring to FIG. 5*b*, the first radiation part 31 is formed to be planar, while the second radiation part 32 is formed to allow its height (H') to be greater than the height (H) of the first radiation part 31. Further, when a current is supplied to the first radiation part 31, a current element 52 is generated in the second radiation part 32 due to electromagnetic coupling. Therefore, both the first and second radiation parts 31 and 32 radiate radio waves. In addition, since the radiating element 52 generated from the second radiation part 32 influences the inside and outside of the first radiation part 31, more radiating elements are formed in the y axis direction, compared to FIG. 5*a*. Further, the second radiation part 32 is formed high in the x axis direction, so that a current can be widely distributed even in the x axis direction, as in the y axis direction. Therefore, the radiation in the x axis direction at higher frequencies induces isotropy to be formed by the current widely distributed along the y axis. In contrast, the radiation in the y axis direction at higher frequencies induces isotropy to be formed by the current widely distributed along the x axis. Through the above principles, the antenna 30 of the present invention can solve the problem of the conventional planar antenna in that radiation characteristics are deteriorated in the x axis direction, and obtain isotropy even at higher frequencies.

Figure 6:
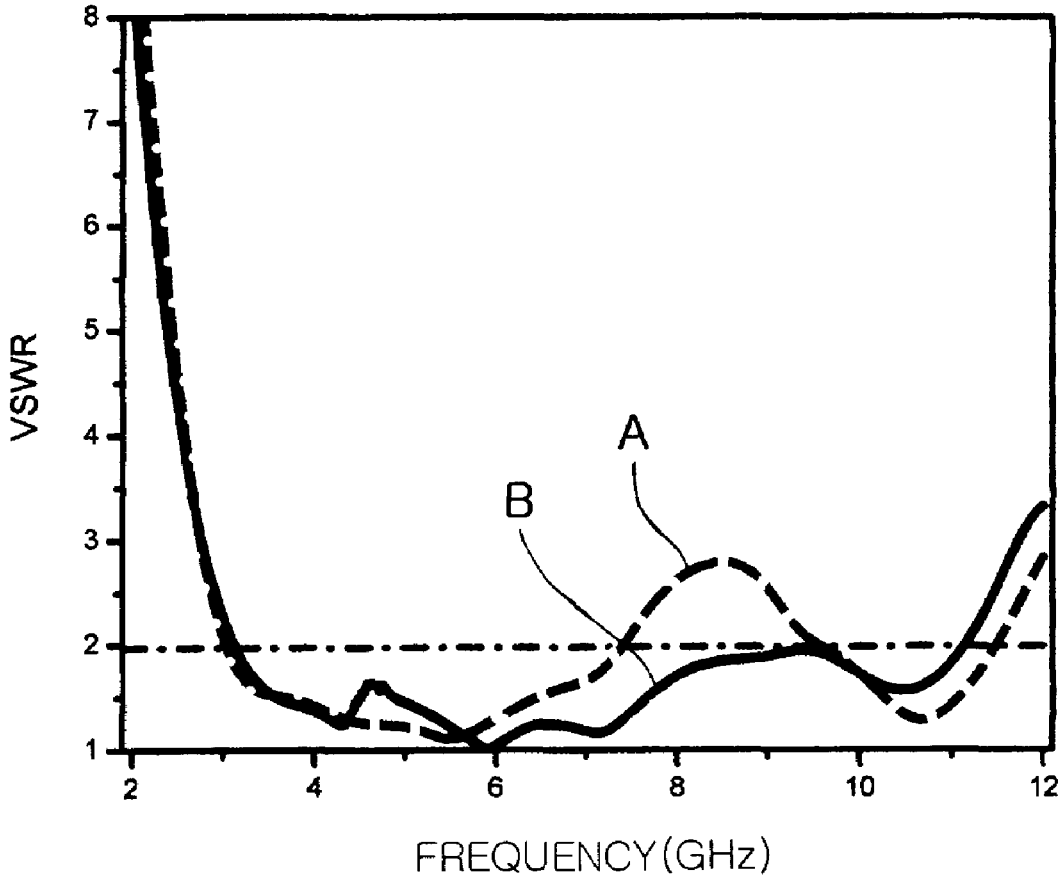
FIG. 6 is a diagram showing the comparison of the Voltage Standing Wave Ratio (VSWR) characteristics of an antenna having a first radiation part with the VSWR characteristics of an antenna having first and second radiation parts according to an embodiment of the present invention.

FIG. 6 is a diagram showing the comparison of the VSWR characteristics of an antenna 30 having a first radiation part 31 with the VSWR characteristics of an antenna 30 having first and second radiation parts 31 and 32 according to an embodiment of the present invention.

In the diagram of FIG. 6, a vertical axis represents a VSWR, which increases in increments of 1 from a minimum value of 1 along the vertical axis. Further, a horizontal axis represents a frequency.

Referring to the diagram of FIG. 6, it can be seen that, if a frequency band with a VSWR of 2 or less is defined as the bandwidth of an antenna, the VSWR (A) of the antenna 30 using only the first radiation part 31 is 2 or less in a frequency band of about 3 to 7 GHz, and is 2 or above in a frequency band of about 7 to 10 GHz, so that the antenna 30 cannot exhibit sufficient ultra wideband characteristics. On the contrary, it can be seen that the VSWR (B) of the antenna 30 having both the first and second radiation parts 31 and 32 is 2 or less in a frequency band of about 3 to 10 GHz, so that the antenna 30 can exhibit ultra wideband characteristics. In this case, the antenna 30 of the present invention adjusts the length of a current path formed in the x axis direction by adjusting the height (H) of the second radiation part 32, thus improving VSWR at a specific frequency.

Figure 7A:
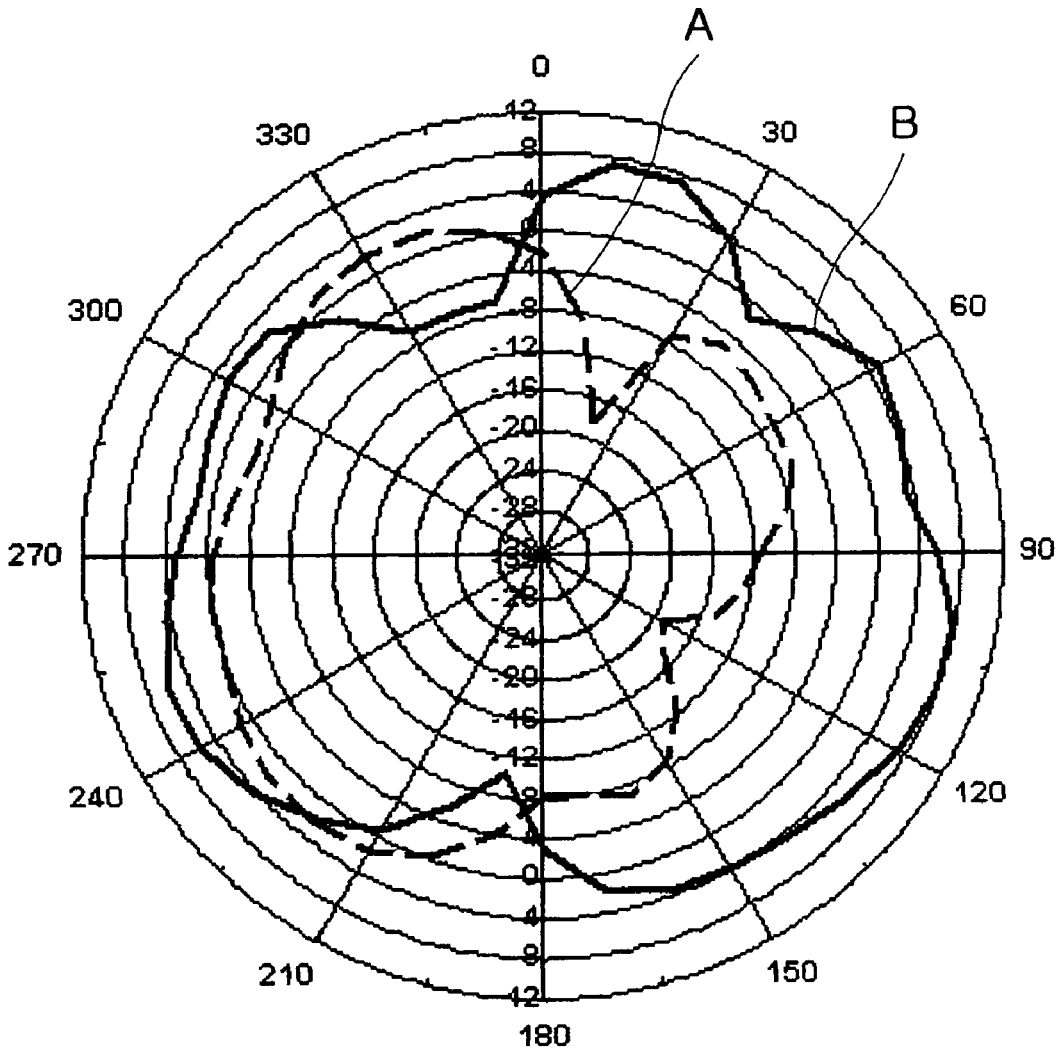
FIGS. 7*a* to 7*d* are diagrams showing the comparison of the radiation patterns of an antenna having a first radiation part with the radiation patterns of an antenna having first and second radiation parts according to an embodiment of the present invention.
Figure 7B:
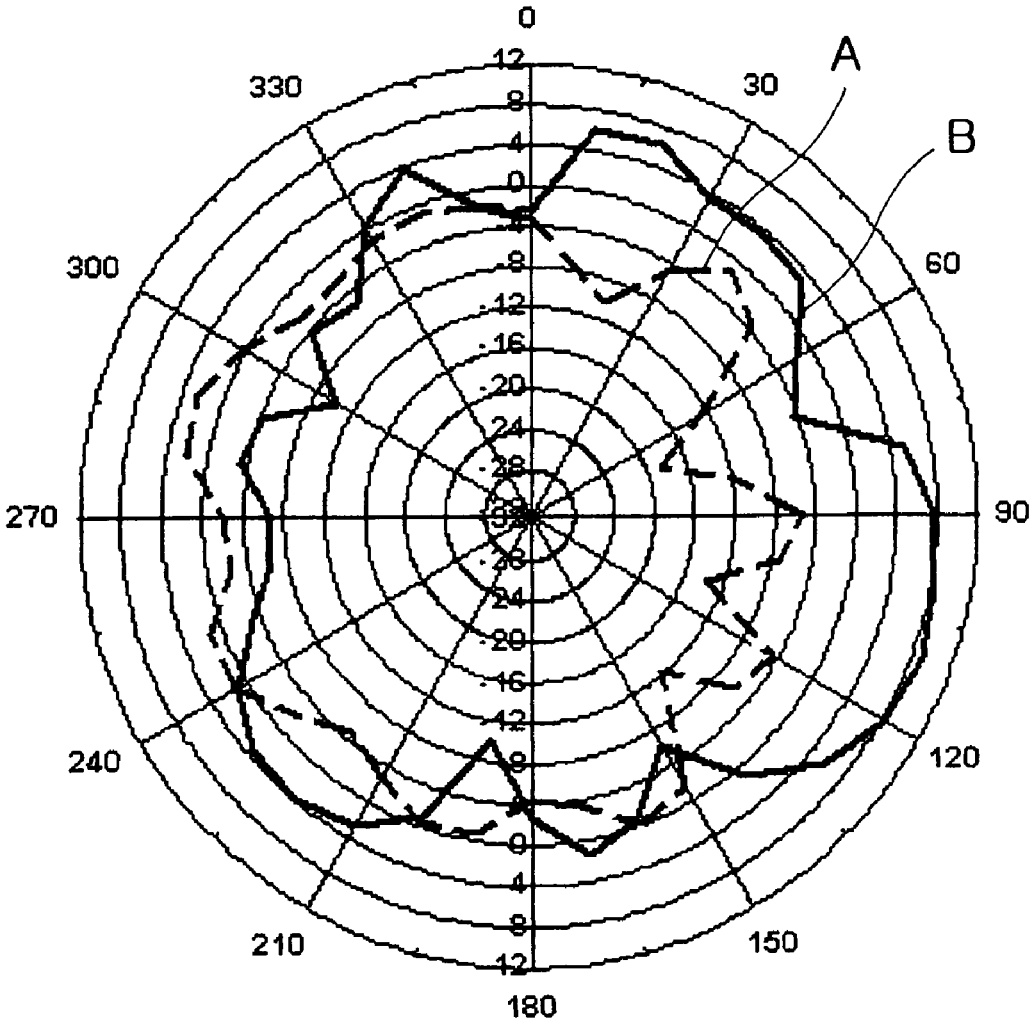
Figure 7C:
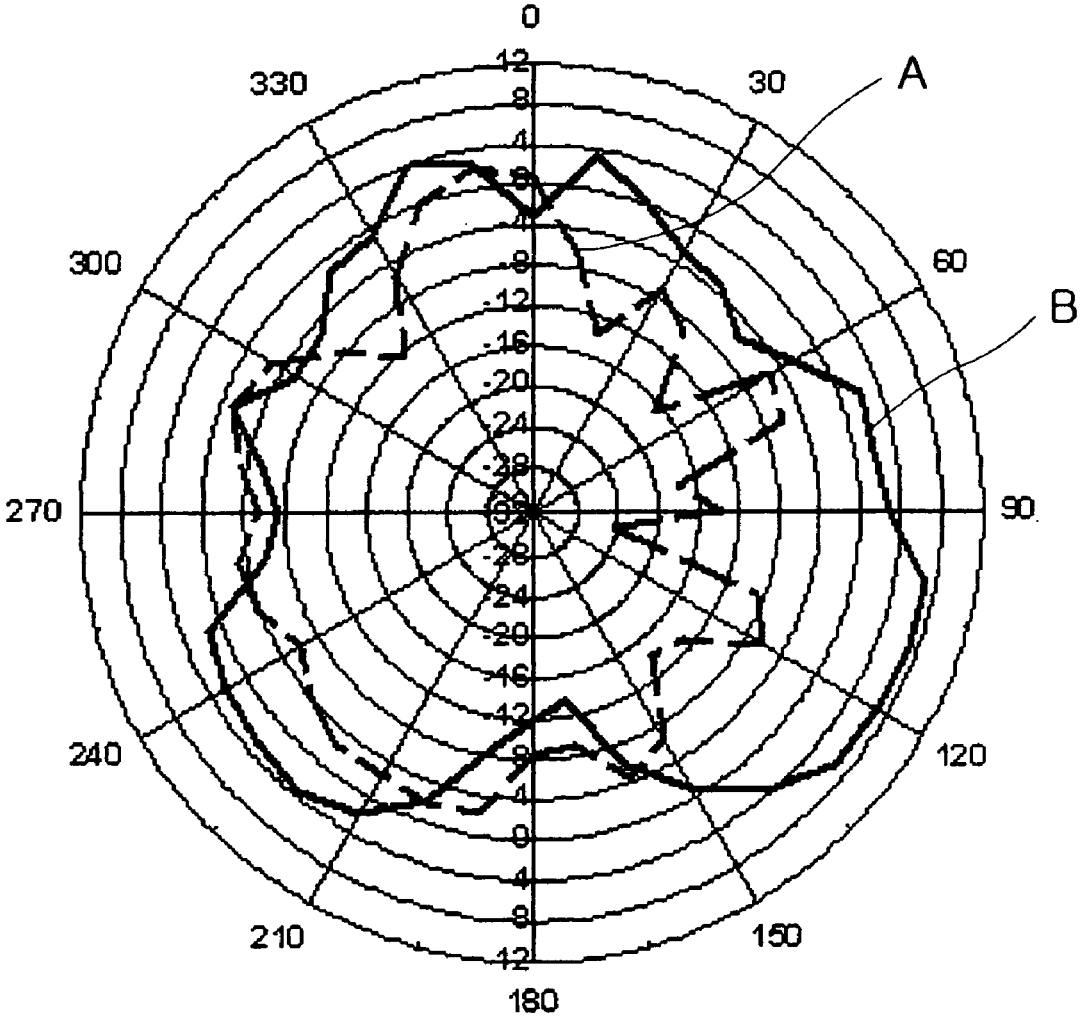
Figure 7D:
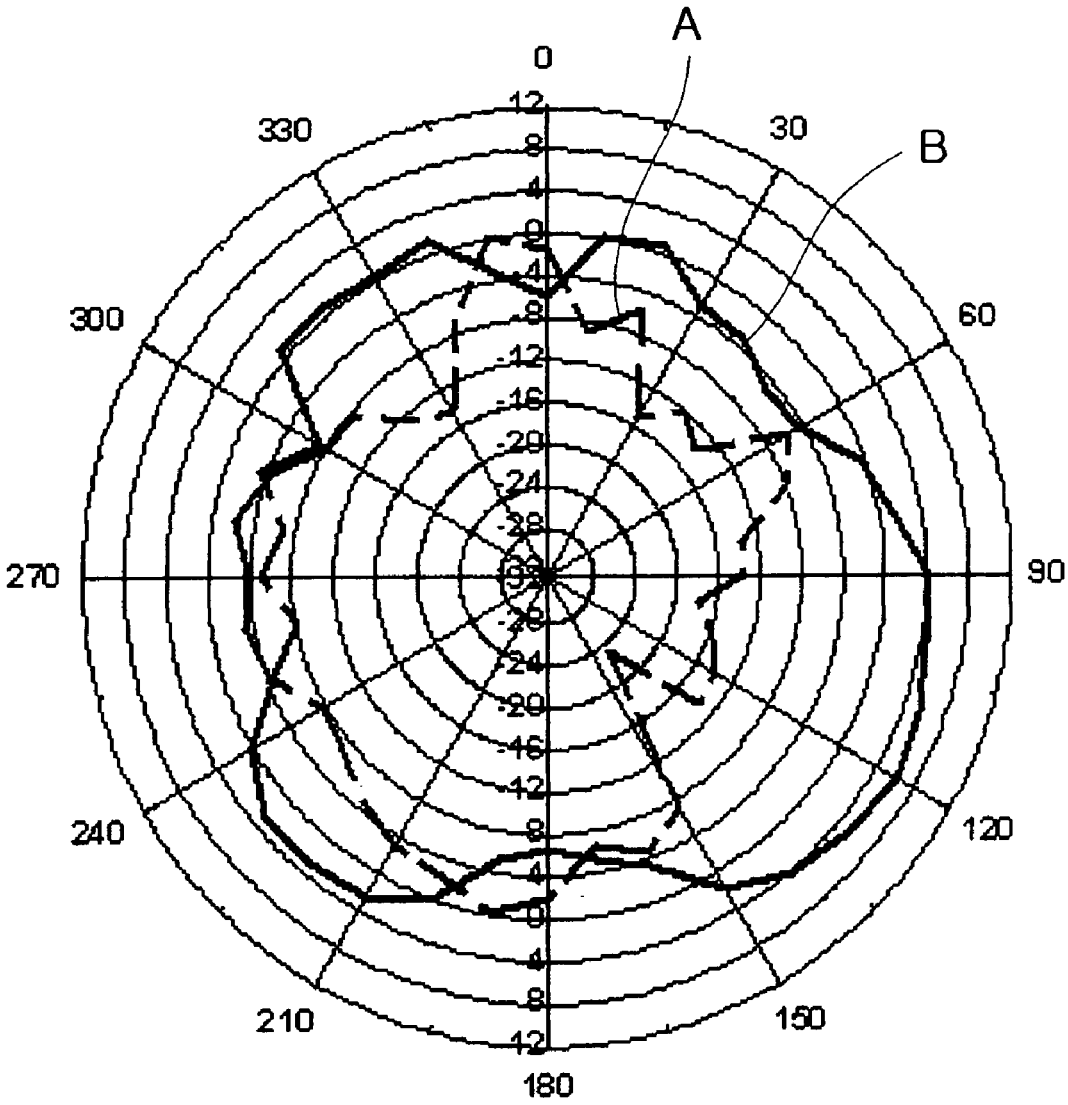

FIGS. 7*a* and 7*d* are diagrams showing the comparison of the radiation patterns of an antenna 30 having a first radiation part 31 with the radiation patterns of an antenna 30 having first and second radiation parts 31 and 32 according to an embodiment of the present invention.

First, FIG. 7*a* is a diagram showing the comparison of the radiation pattern (A) of the first radiation part 31 with the radiation pattern (B) of the antenna 30 having the first and second radiation parts 31 and 32 according to an embodiment of the present invention, in which the radiation patterns are measured at a frequency of 4 GHz. Further, FIGS. 7*b* to 7*d* are diagrams showing the comparison of the radiation pattern (A) of the first radiation part 31 with the radiation pattern (B) of the antenna 30 having both the first and second radiation parts 31 and 32 according to the embodiment of the present invention, in which the radiation patterns are measured at frequencies of 6 GHz, 8 GHz and 10 GHz, respectively.

Referring to FIGS. 7*a* to 7*d*, it can be seen that, in the radiation pattern (A) of the first radiation part 31, directionality becomes more and more distorted and excessive ripples are generated, as a frequency increases to a high frequency of 10 GHz from a low frequency of 2 GHz. On the contrary, the radiation pattern (B) of the antenna 30 having the first and second radiation parts 31 and 32 exhibits uniform radiation characteristics in all directions in 360 degrees around the antenna in all frequency bands, compared to the radiation pattern (A) of the first radiation part 31, and exhibits excellent radiation characteristics in forward and backward directions. On the basis of the results, the ultra wideband internal antenna of the present invention can exhibit satisfactory antenna characteristics compared to the conventional planar antenna while being miniaturized.

As described above, the present invention provides an ultra wideband internal antenna, which is advantageous in that an internal antenna mounted in a mobile communication terminal can be miniaturized while exhibiting excellent radiation characteristics over a frequency band of 3 to 10 GHz. Therefore, the present invention is advantageous in that, if the ultra wideband internal antenna is employed, the miniaturization of a mobile communication terminal and the design freedom thereof can be increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ultra wideband internal antenna, comprising:

a first radiation part formed on a top surface of a dielectric substrate and provided with an internal slot;

a feeding line for supplying a current to the first radiation part;

a second radiation part formed in the internal slot of the first radiation part on the top surface of the dielectric substrate, the second radiation part being conductive; and a ground part for grounding both the first and second radiation parts, wherein the second radiation part determines an ultra wideband by mutual electromagnetic coupling with the first radiation part using a current element induced due to the current supplied to the first radiation part.

2. The ultra wideband internal antenna according to claim 1, wherein the first radiation part has an outer circumference formed in a substantial rectangle shape.

3. The ultra wideband internal antenna according to claim 1, wherein the internal slot of the first radiation part is formed in a substantial circle shape.

4. The ultra wideband internal antenna according to claim 1, wherein the feeding line is formed in a CO-Planar Waveguide Ground (CPWG) structure.

5. The ultra wideband internal antenna according to claim 1, wherein the second radiation part is formed so that a height (H') thereof is greater than a height (H) of the first radiation part.

6. The ultra wideband internal antenna according to claim 1, wherein the second radiation part is formed in a substantial circle shape.

7. The ultra wideband internal antenna according to claim 1, wherein the second radiation part is formed in the shape of a dielectric column, the dielectric column having a top surface to which a conductive material is applied.

8. The ultra wideband internal antenna according to claim 1, wherein the second radiation part is formed in the shape of a dielectric column, the dielectric column having a top surface and side surfaces to which a conductive material is applied.

9. The ultra wideband internal antenna according to claim 1, wherein the second radiation part is formed in the shape of a dielectric column, the dielectric column having a conductive material formed therein.

10. The ultra wideband internal antenna according to claim 1, wherein the second radiation part is made of a conductor.

11. The ultra wideband internal antenna according to claim 1, wherein the ground part includes upper ground parts that are formed on opposite sides of the feeding line on the top surface of the substrate, and lower ground parts that are formed on a bottom surface of the substrate and directly connected to the second radiation part through a conductive line.

* * * * *